US007248173B2

(12) United States Patent
Yamasaki et al.

(10) Patent No.: US 7,248,173 B2
(45) Date of Patent: Jul. 24, 2007

(54) SMOKE DETECTOR

(75) Inventors: Ryoichi Yamasaki, Shibuya-ku (JP); Takeshi Ueno, Shibuya-ku (JP); Yasunori Oya, Shibuya-ku (JP)

(73) Assignee: Nittan Company, Limited, Tokyo (JP)

( * ) Notice: Subject to any disclaimer, the term of this patent is extended or adjusted under 35 U.S.C. 154(b) by 163 days.

(21) Appl. No.: 11/108,747

(22) Filed: Apr. 19, 2005

(65) Prior Publication Data

US 2005/0242967 A1 Nov. 3, 2005

(30) Foreign Application Priority Data

Apr. 21, 2004 (JP) ..... 2004-125466

(51) Int. Cl.
*G08B 17/10* (2006.01)

(52) U.S. Cl. ..... 340/630; 340/628; 340/693.6; 381/181; 348/135

(58) Field of Classification Search ..... 340/630, 340/693.6, 628; 381/181; 348/135
See application file for complete search history.

(56) References Cited

U.S. PATENT DOCUMENTS 4,857,895 A * 8/1989 Kaprelian ..... 340/630
5,231,378 A * 7/1993 Dennis et al. ..... 340/630
6,737,977 B2 * 5/2004 Nishikawa et al. ..... 340/628
2002/0060632 A1 * 5/2002 Kadwell et al. ..... 340/628

FOREIGN PATENT DOCUMENTS

| | | | |
|---|---|---|---|
| JP | 481997 | | 3/1992 |
| JP | 11248628 | | 9/1999 |
| JP | 200065740 | | 3/2000 |
| JP | 200065741 | | 3/2000 |
| JP | 2000065740 | * | 3/2000 |
| JP | 2000065741 A | * | 3/2000 |

OTHER PUBLICATIONS

GB Office Action dated May 20, 2005 (copy attached).

* cited by examiner

*Primary Examiner*—Jeffery Hofsass
*Assistant Examiner*—Hoi C. Lau
(74) *Attorney, Agent, or Firm*—Stevens, Davis, Miller & Mosher, LLP

(57) ABSTRACT

A dark chamber is adapted to accommodate smoke particles. A photo emitter and a photo detector are disposed in the dark chamber. In a first region, a region where light emitted from the photo emitter passes and a region where the photo detector is capable of detecting light are overlapped, so that light emitted from the photo emitter and scattered by the smoke particles is detected by the photo detector. A photo converger converges light passed through the first region at a second region where is an outside of the first region.

8 Claims, 5 Drawing Sheets

SMOKE DETECTOR

BACKGROUND OF THE INVENTION

The present invention relates to a smoke detector.

Smoke detectors for detecting smoke through detection of scattered light by smoke particles have conventionally been proposed and put into practice. Such a smoke detector detects a fire as follows. The smoke detector has a dark chamber for storing a photo emitter and a photo detector. Light emitted from the photo emitter is scattered by smoke particles having flowed into the dark chamber, to thus generate scattered light. The photo detector receives the scattered light.

In recent years, smoke detectors including light traps for inhibiting noise light (light generated by reflection, by an inner wall of the dark chamber, of light having been emitted from the photo emitter) from reaching the photo detector are disclosed in, for example, Japanese Patent Publication Nos. 11-248628A, 2000-65740A and 2000-65741A. When such a smoke detector is adopted, noise light can be caused to enter the light trap, to thus attenuate the noise light. Hence, incidence of the noise light to the photo detector is suppressed, thereby enabling an increase in an S/N ratio to a certain extent.

However, in the smoke detector disclosed in Japanese Patent Publication No. 11-248628A, the light trap is disposed in front of the photo emitter and the photo detector. Therefore, light emitted from the photo emitter is reflected in a direction parallel to a virtual plane including an optical axis of the photo emitter and that of the photo detector. Accordingly, since noise light is easily incident to a light detecting region, occurrence of a false alarm remains highly possible.

The smoke detectors disclosed in Japanese Patent Publication Nos. 2000-65740A and 2000-65741A employs a labyrinth structure for inhibiting light from entering the dark chamber. Since light emitted from the photo emitter is reflected by edge sections of wall members constituting the labyrinth structure, irregular noise light of an amount that cannot be sufficiently attenuated by the light trap is generated. Therefore, the noise light may enter the light detecting region, to thus cause a false alarm.

In addition, in the smoke detectors disclosed in Japanese Patent Publication No. 11-248628A, a plurality of light traps must be disposed; and in the smoke detector disclosed in Japanese Patent Publication Nos. 2000-65740A and 2000-65741A, a light trap must be disposed inside the labyrinth structure within the dark chamber. Accordingly, either case requires a large space for disposing the light trap, whereby miniaturization of the smoke detector has encountered difficulty. In addition, the smoke detector disclosed in Japanese Patent Publication No. 2000-65741A includes another member such as a lens in addition to the light trap, whereby the cost for manufacturing the smoke detector may be increased. Furthermore, the light trap and/or the lens may inhibit smoke from flowing into the dark chamber.

SUMMARY OF THE INVENTION

It is therefore an object of the invention to provide a smoke detector which effectively suppresses incidence of noise light resulting from light emitted from a photo emitter to a light detecting region, to thus increase an S/N ratio by a large extent, thereby enabling significant reduction of false alarms attributed to the noise light.

In order to achieve the above object, according to the invention, there is provided a smoke detector, comprising:

a dark chamber, adapted to accommodate smoke particles;

a photo emitter, disposed in the dark chamber;

a photo detector, disposed in the dark chamber;

a first region, at which a region where light emitted from the photo emitter passes and a region where the photo detector is capable of detecting light are overlapped, so that light emitted from the photo emitter and scattered by the smoke particles is detected by the photo detector; and a photo converger, which converges light passed through the first region at a second region where is an outside of the first region.

With this configuration, light having been emitted from the photo emitter and of relatively high intensity can be maintained separate from the first region, to thus be attenuated at the position outside the first region. Therefore, incidence of noise light deriving from light emitted from the photo emitter to the light detecting region of the photo detector can be suppressed, to thus increase an S/N ratio by a large extent, thereby enabling significant reduction of false alarms attributed to the noise light.

Preferably, the second region is situated at an outside of a virtual plane including an optical axis of the photo emitter and an optical axis of the photo detector.

With this configuration, the photo converger is capable of directly converging light emitted from the photo emitter outside the virtual plane. Hence, noise light resulting from light illuminated from the photo emitter can be very effectively attenuated at the position outside the virtual plane.

Preferably, the dark chamber is provided with a photo attenuator which attenuates light converged by the photo converger.

With this configuration, incidence of noise light deriving from light emitted from the photo emitter to the light detecting region of the photo detector can be further suppressed, thereby increasing an S/N ratio by a large extent.

Preferably, the photo converger includes a concave face configured to reflect the light passed through the first region and to converge the reflected light at the second region.

With this configuration, highly effective attenuation of noise light can be effected by a simple structure.

Here, it is preferable that the concave face faces downward.

With this configuration, accumulation of dust and the like on the concave face can be prevented. Hence, generation of noise light as a result of reflection of light having been emitted from the photo emitter on the dust and the like on the concave face can be prevented, thereby contributing to an increase in the S/N ratio.

Preferably, the photo converger is monolithically formed with the dark chamber.

With this configuration, manufacturing cost can be curtailed. In addition, work required for independently manufacturing the dark chamber and the photo converger and assembling them together can be saved.

Preferably, the dark chamber is provided with a labyrinth structure which allows the smoke particles to enter the dark chamber while preventing external light from entering the first region; and the photo converger constitutes a part of the labyrinth structure.

With this configuration, incidence of external light to the light detecting region is prevented, thereby contributing to an increase in the S/N ratio. In addition, since the photo converger constitutes a part of the labyrinth structure, a space for disposing the photo converger does not have to be secured inside or outside of the labyrinth structure. Therefore, miniaturization of the smoke detector can be realized, and flexibility in arrangement of the photo emitter and the photo detector inside the dark chamber can be enhanced.

Preferably, the photo converger has a streamlined face which faces an outside of the dark chamber.

With this configuration, smoke (smoke particles) can be smoothly caused to flow into the dark chamber. Accordingly, fire can be detected without fail, thereby contributing to saving lives and property.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Embodiments of the invention will be described below in detail by reference to the accompanying drawings.

First, a smoke detector according to a first embodiment will be described by reference to FIGS. 1 to 8.

Figure 1:
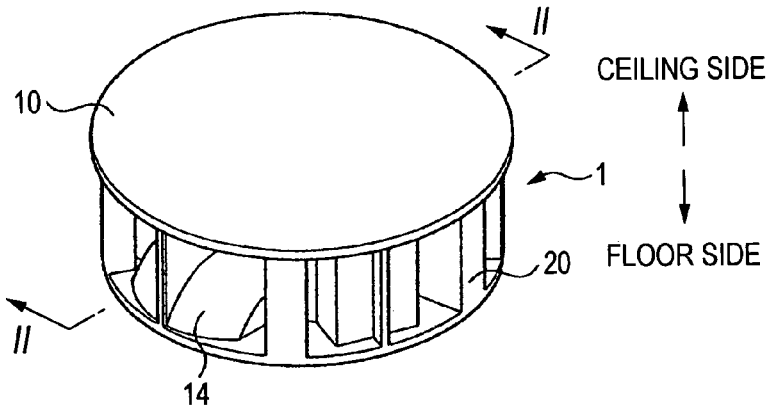
FIG. 1 is a perspective view of a dark chamber of a smoke detector according to a first embodiment of the invention.
Figure 2:
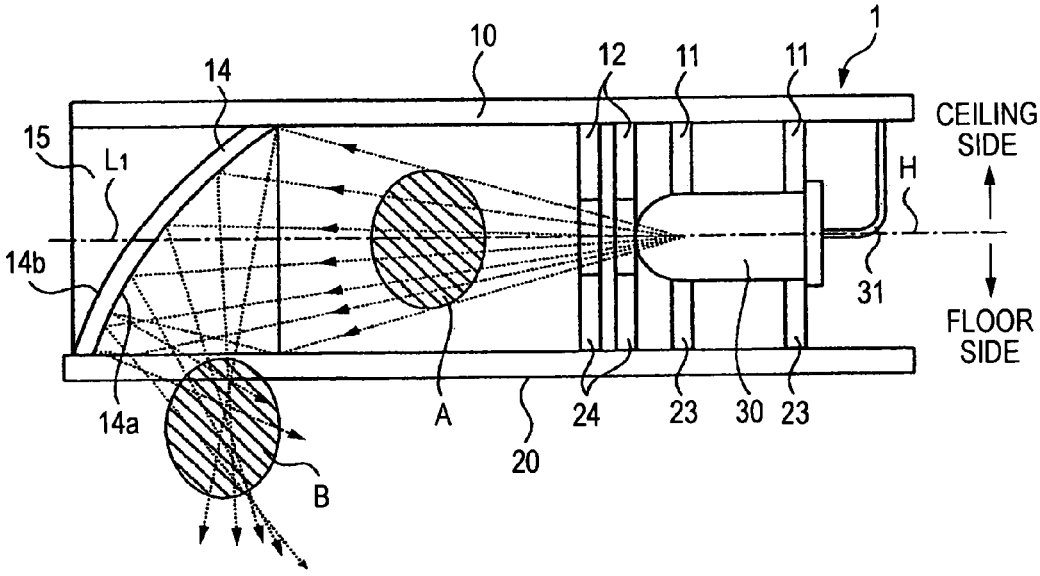
FIG. 2 is a section view of the dark chamber of FIG. 1.
Figure 3:
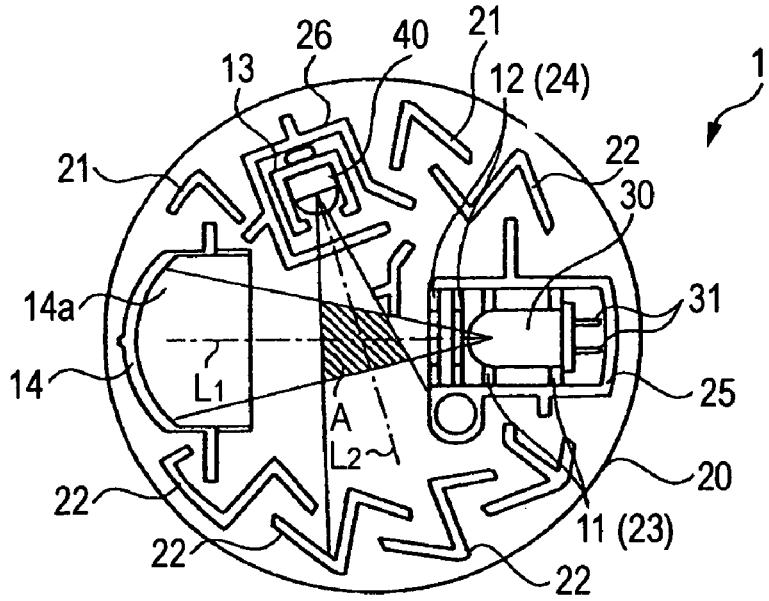
FIG. 3 is a plan view for explaining an internal structure of the dark chamber of FIG. 1.

As shown in FIGS. 1 to 3, the smoke detector comprises a dark chamber 1 of a thick disk-shape constituted of an upper member 10 and a lower member 20; a photo emitter (light-emitting element) 30 and a photo detector (light-sensitive element) 40, both of which are disposed inside the dark chamber 1; an unillustrated circuit board for controlling the photo emitter 30 and the photo detector 40. The smoke detector is installed on a ceiling with the upper member 10 facing a ceiling and the lower member 20 facing a floor. The photo detector 40 receives scattered light in a predetermined smoke detecting region A (see FIGS. 2 and 3), whereby the smoke detector detects a fire.

As shown in FIGS. 1 and 4 to 6, the upper member 10 has a tabular member which is circular in a plan view, and a variety of members disposed on the lower face of the tabular member. The upper-member 10 and the lower member 20 constitute the dark chamber 1, and are disposed below the unillustrated circuit board which is disposed on the ceiling side.

Figure 4:
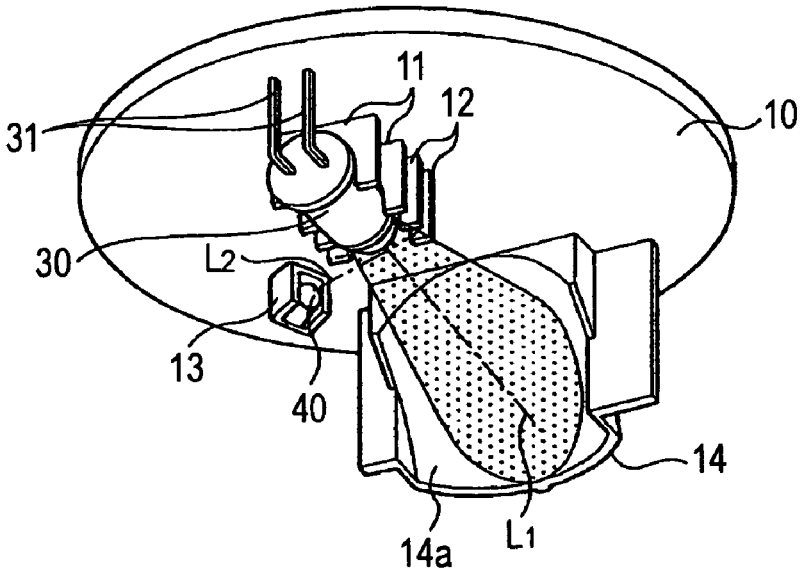
FIGS. 4 and 5 are perspective views of an upper part of the dark chamber of FIG. 1.
Figure 5:
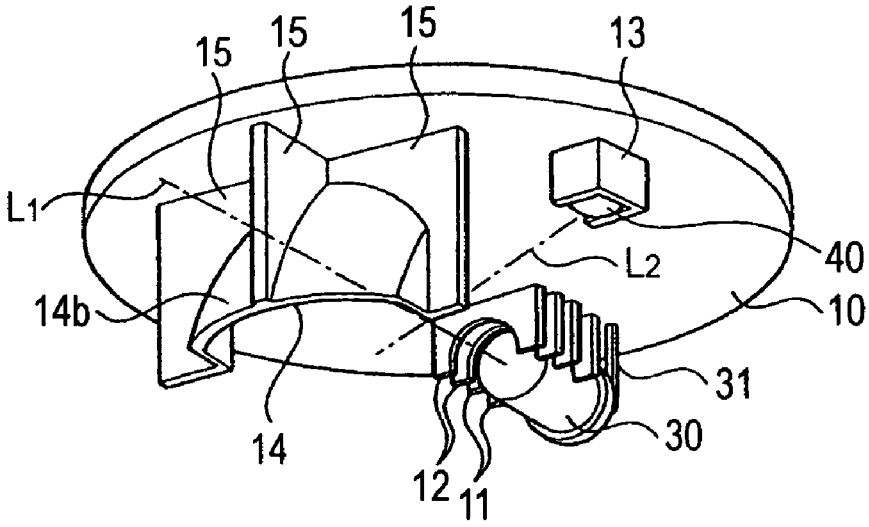
Figure 6:
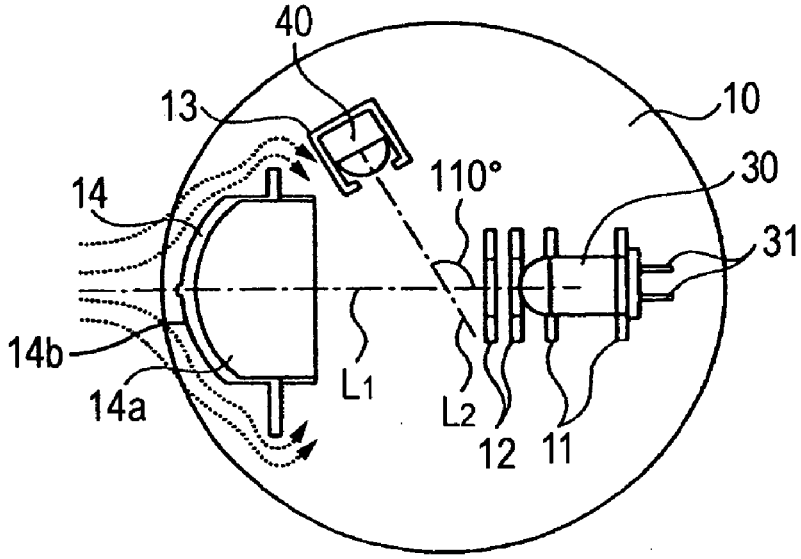
FIG. 6 is a plan view of the upper part of the dark chamber of FIG. 1.

As shown in FIGS. 4 to 6, a holder 11 for holding the photo emitter 30, an iris member (aperture) 12 disposed in the vicinity of the holder 11, a holder 13 for holding the photo detector 40, a reflective converger (light-converging element) 14 which reflects light having been emitted from the photo emitter 30 to thus cause the light to converge at a predetermined region B (see FIG. 2), and the like, are disposed on the lower face of the tabular member of the upper member 10.

In the embodiment, for the purpose of suppressing light reflection, the tabular member of the upper member 10 and the variety of members (the holder 11, the iris member 12, the holder 13, and the reflective converger 14) disposed on the lower face of the tabular member are integrally formed from black synthetic resin.

Figure 7:
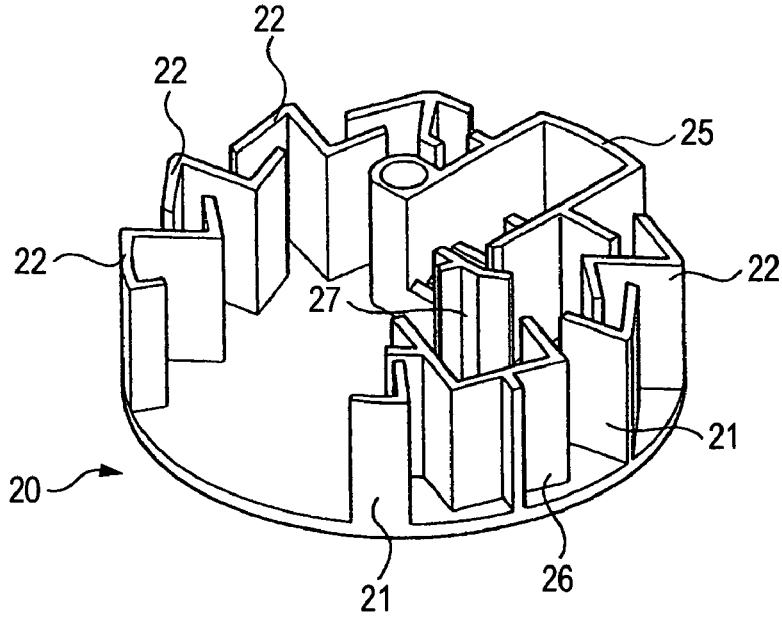
FIG. 7 is a perspective view of a lower part of the dark chamber of FIG. 1.
Figure 8:
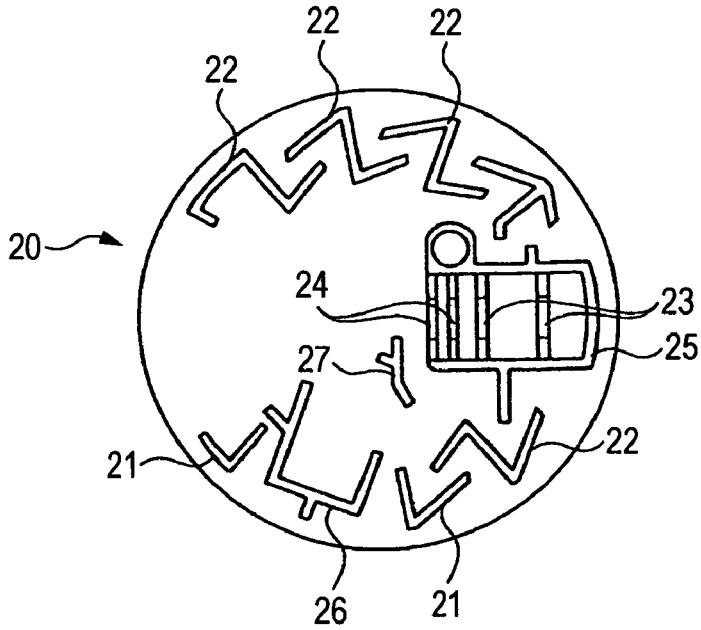
FIG. 8 is a plan view of the lower part of the dark chamber of FIG. 1.

As shown in FIGS. 7 and 8, the lower member 20 includes a tabular member which is circular in a plan view, and a variety of members which are disposed on the upper face of the tabular member and which partially constitute the labyrinth structure. The lower member 20 and the upper member 10 constitute the dark chamber 1. Incidentally, the labyrinth structure is such a structure that allows smoke to flow into the dark chamber 1 while preventing light from entering the same.

As shown in FIGS. 7 and 8, on the upper face of the tabular member of the lower member 20, there are disposed a plurality of wall members 21 respectively having an L-shaped cross section and a plurality of wall members 22 respectively having a Z-shaped cross section which constitute a portion of the labyrinth structure, a holder 23 paired with the holder 11 of the upper member 10, an iris member 24 paired with the iris member 12 of the upper member 10, a shielding wall 25 for shielding photo emitter 30 from the rear and lateral directions, a shielding wall 26 for shielding the holder 13 from the rear and lateral directions, a shielding wall 27 disposed in a position between the photo emitter 30 and the photo detector 40, and the like.

In the embodiment, for the purpose of suppressing light reflection, the lower member 20 (including the wall members 21, the wall members 22, the holder 23, the iris member 24, the shielding wall 25, the shielding wall 26, and the shielding wall 27) are integrally formed from black synthetic resin.

The photo emitter 30 is a light source for generating scattered light for detecting smoke, and is electrically connected to the circuit board by way of a lead wire 31.

As shown in FIGS. 2 to 6, the photo emitter 30 is held by the upper and lower holders 11 and 23 in such a manner that an optical axis $L_1$ of the photo emitter 30 extends in a direction parallel to the tabular member of the upper member 10 and parallel to the same of the lower member 20. The photo emitter 30 is shielded from the rear and lateral directions by the shielding wall 25 as shown in FIG. 3. The area illuminated (irradiated) by light emitted from the photo emitter 30 is narrowed by the upper and lower iris members 12 and 24 as shown in FIGS. 2 and 3. In addition, the shielding wall 27 can inhibit light emitted from the photo emitter 30 from directly entering the photo detector 40.

The photo detector 40 receives scattered light (light generated by scattering of light emitted from the photo emitter 30, by smoke particles having flowed into the dark chamber 1) in the smoke detecting region A shown in FIGS. 2 and 3. The photo detector 40 is electrically connected to the circuit board by way of an unillustrated lead wire.

As shown in FIGS. 3 to 6, the photo detector 40 is held by the holder 13 in such a manner that an optical axis $L_2$ of the photo detector 40 extends in a direction parallel to the tabular member of the upper member 10 and parallel to the same of the lower member 20. The photo detector 40 is shielded from the rear and lateral directions by the shielding wall 26 as shown in FIG. 3. In addition, the shielding wall 27 can inhibit light emitted from the photo emitter 30 from directly entering the photo detector 40.

Meanwhile, as shown in FIG. 3, the smoke detecting region A is a region where an illumination region of the photo emitter 30 and a light detecting region of the photo detector 40 overlap, and includes an intersection of the optical axis $L_1$ of the photo emitter 30 and the optical axis $L_2$ of the photo detector 40. In addition, in the embodiment, as shown in FIGS. 3 and 6, the photo emitter 30 and the photo detector 40 are disposed so that the optical axis $L_1$ of the photo emitter 30 and the optical axis $L_2$ of the photo detector 40 intersect at a center section of the upper member 10; and an angle formed by the optical axes $L_1$ and $L_2$ is set to substantially 110°.

As shown in FIG. 2, the reflective converger 14 causes light having been emitted from the photo emitter 30 and passed through the smoke detecting region A to converge at the predetermined light-converging region B located outside the smoke detecting region A. In the embodiment, the light-converging region B is set below (i.e., at the floor side of) a virtual plane H which includes the optical axis $L_1$ of the photo emitter 30 and the optical axis $L_2$ of the photo detector 40. Accordingly, light having been emitted from the photo emitter 30 and of relatively high intensity can be immediately maintained separate from the smoke detecting region A.

As shown in FIGS. 2 to 4 and 6, the reflective converger 14 has a concave face (a curved surface formed into a concave shape) 14*a* for reflecting light having been emitted from the photo emitter 30 and passed through the smoke detecting region A toward the light-converging region 8, to thus converge the light. An essential requirement for a shape of the concave face 14*a* is to be capable of reflecting light having been emitted from the photo emitter 30 and passed through the smoke detecting region A toward the light-converging region B below the virtual plane H, to thus converge the light. Accordingly, for instance, a shape of an arc section as shown in FIG. 2 or that of a parabola section can be employed. The shape of the concave face 14*a* can be changed in accordance with a position of the light-converging region B, the illumination region of the photo emitter 30, a distance between the photo emitter 30 and the reflective converger 14, and the like, as required.

The concave face 14*a* of the reflective converger 14 is caused to face the floor face side (downward) as shown in FIG. 2. By virtue of this configuration, accumulation of dust on the concave face 14*a* can be prevented. In addition, shielding walls 15 as shown in FIG. 5 are disposed in the rear and lateral directions of the reflective converger 14. As shown in FIG. 3, the reflective converger 14, the wall members 21, the wall members 22, the shielding wall 25, the shielding wall 26, and the like constitute the labyrinth structure. In other words, the reflective converger 14 constitutes a portion of the labyrinth structure. In addition, a back face 14*b* (i.e., a backside face of the concave face 14*a*) of the reflective converger 14 is of a smooth, streamlined shape as shown in FIG. 5.

The smoke detector according to the above-described embodiment includes the reflective converger 14 which causes light having been emitted from the photo emitter 30 and passed through the smoke detecting region A to converge at the predetermined light-converging region B located outside the smoke detecting region A. Therefore, light having been emitted from the photo emitter 30 and of relatively high intensity can be maintained separate from the smoke detecting region A, to thus be attenuated at the position outside the smoke detecting region A. More specifically, the smoke detector is configured such that light emitted from the photo emitter 30 is reflected by the reflective converger 14, to thus be converged at the light-converging region B below the reflective converger. By virtue of this configuration, the light having been reflected by the reflective converger 14 is reflected by the tabular member of the lower member 20, and thereafter reflected upward and downward by inner walls of the dark chamber 1 a plurality of times, to thus be attenuated. Therefore, incidence of noise light deriving from light emitted from the photo emitter 30 to the light detecting region can be suppressed, to thus increase an S/N ratio by a large extent, thereby enabling significant reduction of false alarms attributed to the noise light.

In addition, the light-converging region B is disposed outside the virtual plane H including the optical axis $L_1$ of the photo emitter 30 and the optical axis $L_2$ of the photo detector 40 (at a position located a predetermined distance downward of the virtual plane H). Therefore, the reflective converger 14 is configured to first converge light emitted from the photo emitter 30 outside the virtual plane. Hence, noise light resulting from light illuminated from the photo emitter 30 can be very effectively attenuated at the position outside the virtual plane Since the concave face 14*a* reflects light having been emitted from the photo emitter 30 and passed through the smoke detecting region A toward the light-converging region B, to thus converge the light. Therefore, highly effective attenuation of noise light can be effected by a simple structure.

Since the concave face 14*a* of the reflective converger 14 faces downward, accumulation of dust and the like on the concave face 14*a* can be prevented. Hence, generation of noise light as a result of reflection of light having been emitted from the photo emitter 30 on the dust and the like on the concave face 14*a* can be prevented, thereby contributing to an increase in the S/N ratio.

Since the reflective converger 14 of the smoke detector is monolithically formed with the upper member 10 constituting the dark chamber 1, manufacturing cost can be curtailed. In addition, work required for independently manufacturing the upper member 10 of the dark chamber 1 and the reflective converger 14 and assembling them together can be saved.

The smoke detector employs the labyrinth structure for inhibiting incidence of light into the dark chamber 1. Therefore, incidence of external light to the light detecting region is prevented, thereby contributing to an increase in the S/N ratio. In addition, since the reflective converger 14 constitutes a portion of the labyrinth structure, a space for disposing the reflective converger 14 does not have to be secured inside or outside of the labyrinth structure. Therefore, miniaturization of the smoke detector can be realized, and flexibility in arrangement of the photo emitter 30 and the photo detector 40 inside the dark chamber 1 can be enhanced Since an external shape (i.e., a shape of the back face 14*b*) of the reflective converger 14 constituting a portion of the labyrinth structure is streamlined, smoke can be smoothly caused to flow into the dark chamber 1. Accordingly, fire can be detected without fail, thereby contributing to saving lives and property.

In the first embodiment, the reflective converger 14 is configured such that the light-converging region B is set below (i.e., at the floor face side of) the smoke detecting region A. However, the configuration of the reflective converger is not limited thereto. For instance, there can be employed a reflective converger which causes light having been emitted from the photo emitter 30 to reflect toward a light-converging region is set above (i.e., at the ceiling face side of) the smoke detecting region A, to thus converge the light.

In the first embodiment, a the reflective converger 14 includes the concave face 14*a*. However, a curved surface is not requisite; a concave face constituted of a polyhedron formed from a combination of a plurality of flat faces into a concave shape may be employed.

Figure 9:
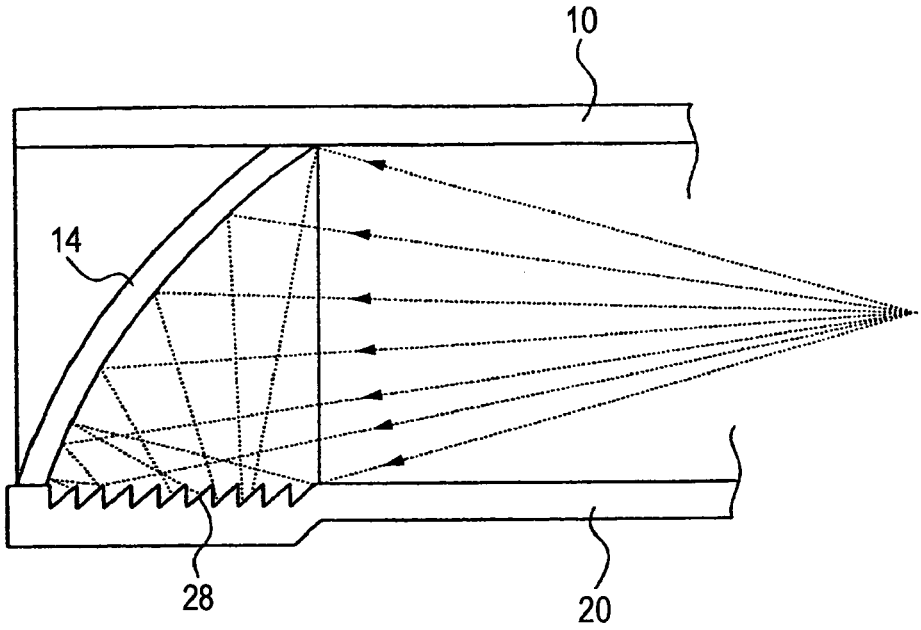
FIG. 9 is a section view of a dark chamber of a smoke detector according to a second embodiment of the invention.

Next, a second embodiment of the invention will be described with reference to FIG. 9. In the first embodiment, light having been reflected by the reflective converger 14 is again reflected by the tabular member of the lower member 20 before reaching the light-converging region B, and thereafter the light is attenuated while being reflected by the inner walls of the dark chamber 1 for a plurality of times. However, as shown in FIG. 9, light can be attenuated by forming a saw-toothed section 28 on a light-incidence face (a face to which light having been reflected by the reflective converger 14 is incident) of the tabular member of the lower member 20, to thus scatter light on the saw-toothed section 28. The saw-toothed section 28 in this case serves as the attenuator. When such a attenuator is disposed, incidence of noise light to the light detecting region can be suppressed further effectively, thereby enabling a further increase in the S/N ratio.

Figure 10:
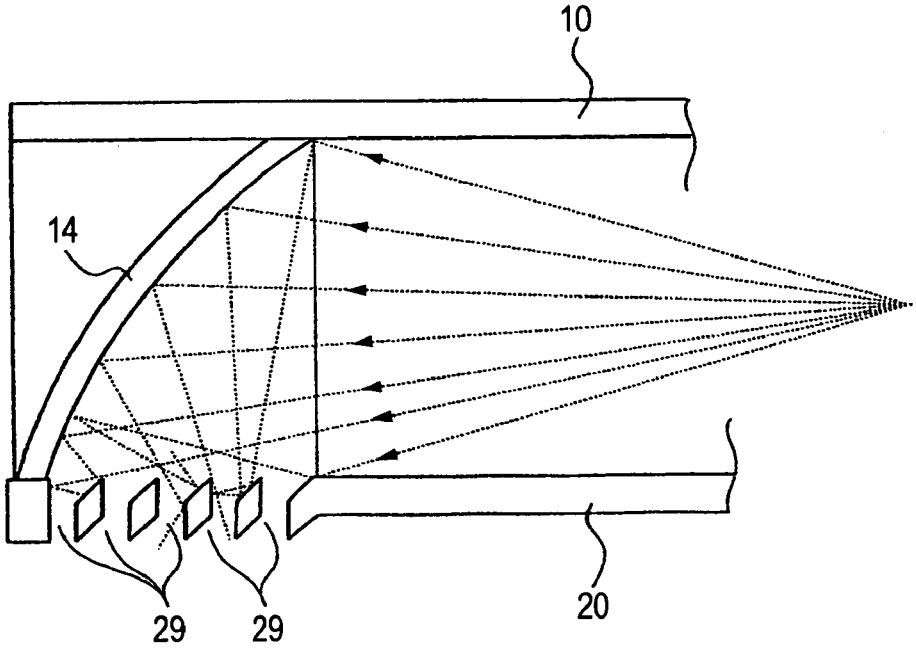
FIG. 10 is a section view of a dark chamber of a smoke detector according to a third embodiment of the invention.

Alternatively, the following configuration can also be employed as a third embodiment of the invention. A plurality of slits 29 are formed on the light-incidence face of the tabular member of the lower member 20 as shown in FIG. 10 in place of the saw-toothed section 28 shown in FIG. 9, thereby causing light to escape to the outside through the slits 29. The slits 29 in this case also serve as the attenuator.

In the above embodiments, the dark chamber 1 is of a thick disk-shaped and circular in plan view has been described. However, the shape of the dark chamber 1 is not limited thereto.

In the above embodiments, the reflective converger 14, the shielding wall 25, and the shielding wall 26 are rendered to be a portion of the labyrinth structure. However, the labyrinth structure may be constituted of the wall members 21 and the wall members 22; and the reflective converger 14, the shielding wall 25, and the shielding wall 26 may be disposed inside the labyrinth structure.

What is claimed is:

1. A smoke detector, comprising:

a dark chamber, adapted to accommodate smoke particles;

a photo emitter, disposed in the dark chamber;

a photo detector, disposed in the dark chamber;

a first region, at which an illumination region where light emitted from the photo emitter passes and a light detecting region where the photo detector is capable of detecting light are overlapped, so that light emitted from the photo emitter and scattered by the smoke particles is detected by the photo detector; and a reflective photo converger, which converges light passed through the first region at a second region which is located outside of the first region.

2. The smoke detector as set forth in claim 1, wherein the second region is situated outside of a plane defined by an optical axis of the photo emitter and an optical axis of the photo detector.

3. The smoke detector as set forth in claim 1, wherein the dark chamber is provided with a photo attenuator which attenuates light converged by the photo converger.

4. The smoke detector as set forth in claim 1, wherein the reflective photo converger includes a concave face configured to reflect the light passed through the first region and to converge the reflected light at the second region.

5. The smoke detector as set forth in claim 4, wherein the concave face faces downward.

6. The smoke detector as set forth in claim 1, wherein the reflective photo converger is monolithically formed with the dark chamber.

7. The smoke detector as set forth in claim 1, wherein:

the dark chamber is provided with a labyrinth structure which allows the smoke particles to enter the dark chamber while preventing external light from entering the first region; and the reflective photo converger constitutes a part of the labyrinth structure.

8. The smoke detector as set forth in claim 1, wherein the reflective photo converger has a streamlined face which faces an outside of the dark chamber.

* * * * *